United States Patent [19]

Moller

[11] 4,155,580

[45] May 22, 1979

[54] COMBINATION DEVICE INCORPORATING A FOOT MOUNTABLE SCOOP

[76] Inventor: Bynum W. Moller, P.O. Box 688, Kerrville, Tex. 78028

[21] Appl. No.: 877,666

[22] Filed: Feb. 14, 1978

[51] Int. Cl.[2] ..... A01B 13/08

[52] U.S. Cl. ..... 294/1 R; D6/89

[58] Field of Search ..... 294/1 R, 25, 55; 36/8.1, 11, 5; D6/89; 68/228; 273/100

[56] References Cited

U.S. PATENT DOCUMENTS 3,628,794 12/1971 Conture ..... 273/100

3,693,923 9/1972 Ayoub et al. ..... D6/89

3,910,661 10/1975 Geary ..... D6/89

*Primary Examiner*—James B. Marbert

*Attorney, Agent, or Firm*—G. Turner Moller

[57] ABSTRACT

There is disclosed a combination device which may be used as a soap dish or as a soap retriever. The device comprises a bracket mountable on a wall releasably supporting the soap retriever. The soap retriever comprises a foot mountable scoop which can be removed from the bracket and placed on the floor of the shower. The user then places his bare foot or a bare toe in a cavity provided by the scoop for supporting and manipulating the scoop for retrieving soap or other articles from the shower floor.

17 Claims, 2 Drawing Figures

COMBINATION DEVICE INCORPORATING A FOOT MOUNTABLE SCOOP

Figure 1:
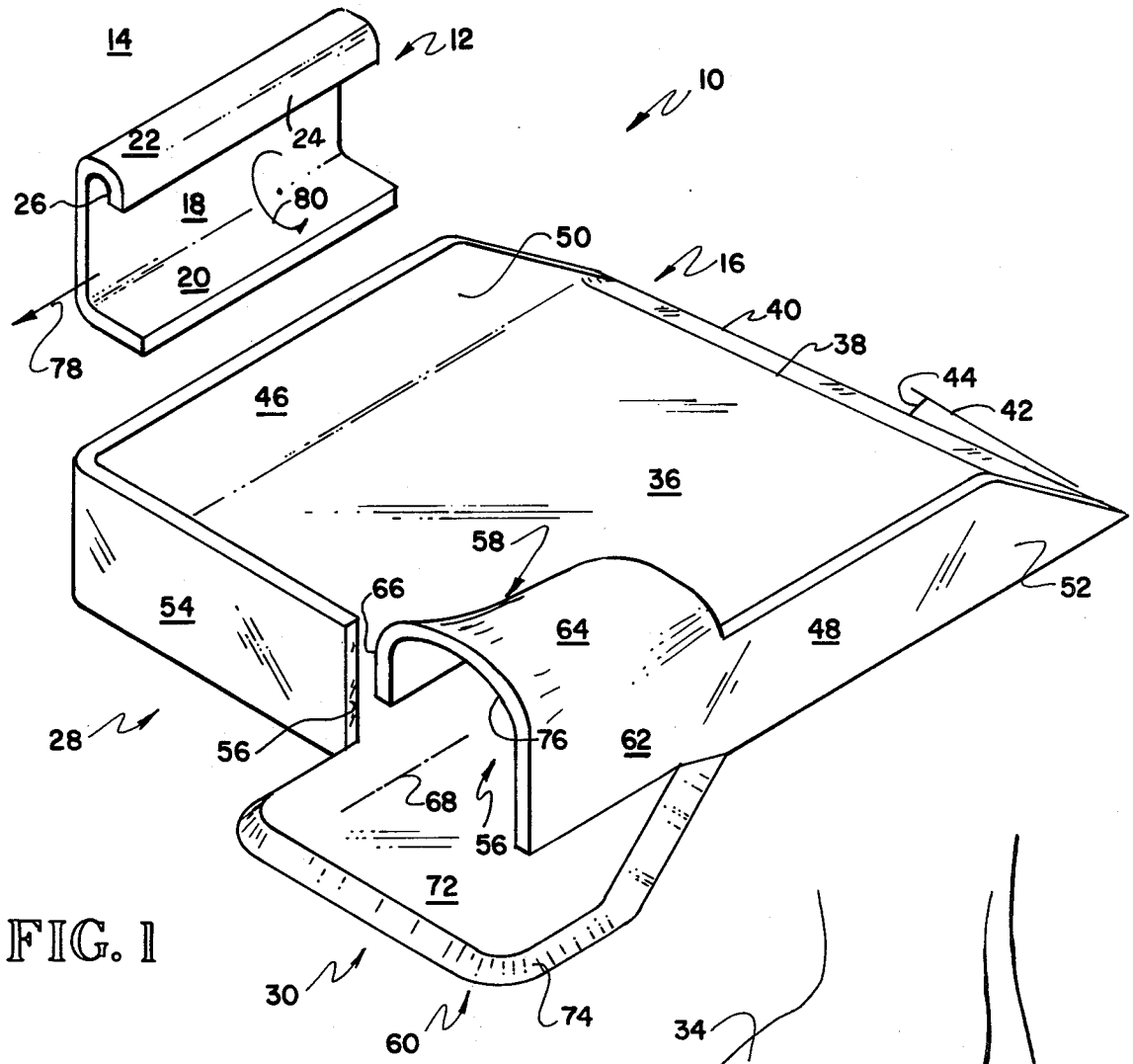

This invention relates to a foot mountable scoop and more particularly to a foot mountable scoop which is used to retrieve soap from a shower floor and which may be releasibly supported by a bracket on the shower wall to convert the scoop into a soap dish.

The provision of foot mounted scoops for this purpose is apparently unknown although it is known to mount a scoop appearing structure on the shoe of an individual in the playing of games as shown in U.S. Pat. Nos. 1,637,278 and 3,628,794. It will be evident that these devices are not designed to be supported or manipulated by a bare toe or foot of an individual. It is also apparent that these devices have not been used to retrieve soap from a shower floor.

It is known in the art to provide devices having cavities or openings therein which are designed or which may inherently be capable of receiving a body member and which further comprise a flat or concave section on which an article conceivably could be positioned, as shown in U.S. Pat. Nos. 622,386; 1,674,294 and 2,444,491. It is evident that these devices are not foot mounted and are not designed as scoops.

It is also known in the art to provide a multi-purpose device which functions as a receptacle in one mode of operation and which acts as a scoop in another mode of operation as shown in U.S. Pat. No. 2,967,729.

In summary, this invention comprises a foot mountable scoop comprising a receptacle having a rearwardly opened passage for receiving one or more bare toes of a user. The passage is desirably adjacent one side of the receptacle which further provides a rearwardly and laterally extending member projecting under the ball of the user's foot to prevent rotation of the receptacle about the axis of the passage.

The scoop is conveniently removably mounted on a bracket attached to the wall of a shower. Normally, the scoop acts as a soap dish to support soap therein in a conventional manner. When the user is in the shower and drops soap onto the shower floor, the scoop may be removed from the bracket and dropped on the shower floor. The user then extends a bare toe or toes into the passage and thereby manipulates the scoop to slide the front receptacle end under the soap to be retrieved. When the soap bar is in the receptacle, the user may retrieve the soap and scoop merely by raising the foot engaged with the receptacle and retrieving the receptacle, with the soap, off of the bare toe or toes. In this manner, the user does not have to bend over in the shower and thereby avoids getting his head wet. The recepticle is then returned to the bracket on the wall and the soap is in hand.

It is accordingly an object of this invention to provide a combined soap dish and soap retriever.

Another object of this invention is to provide a foot mountable scoop.

Other objects and a fuller understanding of the invention may be had by referring to the following description of the preferred embodiment and claims taken in conjunction with the accompanying drawing.

IN THE DRAWING

Figure 2:
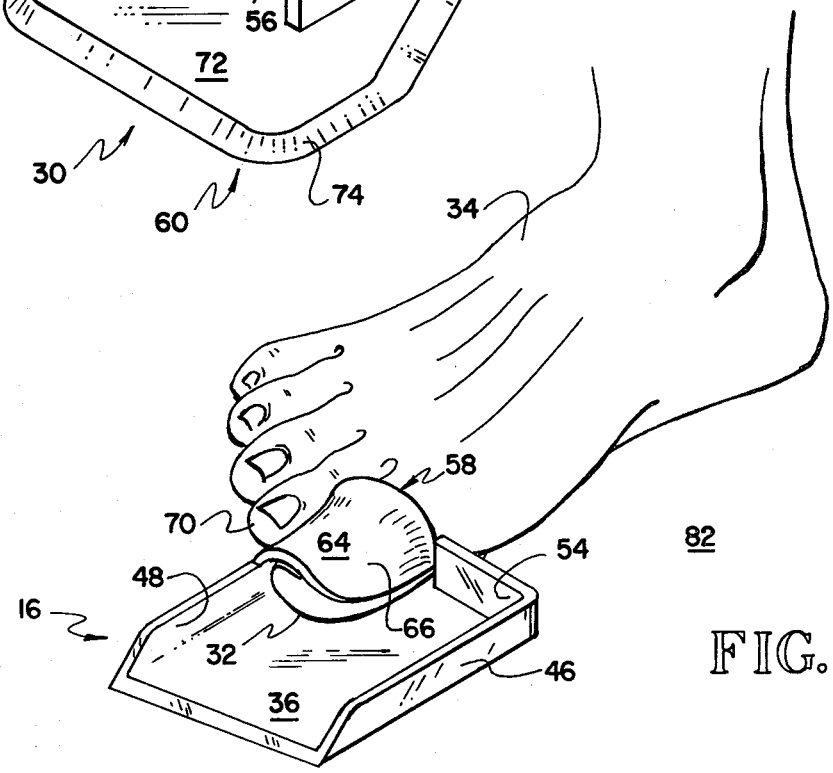

FIG. 1 is an exploded isometric view of the bracket and foot mountable scoop; and FIG. 2 is an isometric view of the scoop of FIG. 1 illustrated in operative position on the foot of the user.

Referring to FIG. 1, there is illustrated a combined soap dish and soap retriever 10 comprising a bracket 12 for securement to a wall 14 and a foot mountable scoop 16.

The bracket 12 may be of any suitable description and is illustrated as a generally C-shaped unitary structure having a planar back wall 18, a planar bottom wall 20 generally perpendicular to the back wall 18, a top wall 22 which extends in the same direction as the bottom wall 20 but which is substantially shorter, and a lip 24 which extends generally parallel to the back wall 18 and which provides therewith a slot 26 for receiving a wall of the foot mountable scoop. The bracker 12 may be attached to the wall 14 in any suitable fashion, as by adhesively securing the back wall 18 thereto or by using suitable threaded fasteners.

The foot mountable scoop 16 comprises a receptacle 28 and means 30 for supporting the receptacle on a bare toe 32 of a user's foot 34.

The receptacle 28 comprises a planar bottom wall 36 providing a beveled front edge 38. The beveled front edge 38 provides a lowermost leading edge 40 which is preferably offset or inclined from a line 42 perpendicular to the side of the receptacle 28 by a small acute angle 44. the acute angle 44 is typically on the order of about 5°–20°. The receptacle 28 also comprises side walls 46, 48 which extend upwardly from the bottom wall 36 throughout a major length of the sides of the receptacle 28. The forward edges 50, 52 of the side walls 46, 48 are desirably beveled at the same angle as the front edge 38. The receptacle 28 also comprises a rear wall 54 which merges with the side wall 46 and which terminates short of the opposite side of the receptacle 28 to provide an opening 56 in the rear of the receptacle 28.

The supporting means 30 comprises an arcuate toe engaging structure 58 and a planar structure 60 which underlies the ball of the user's foot 34. The arcuate toe engaging structure 58 comprises a section 62 substantially coplanar with the side wall 48, an arcuate top wall 64 overlying the user's big toe 32 and a depending section 66 which is positioned to engage the side of the user's big toe. The arcuate toe engaging structure 58 accordingly defines an axis 68 of toe inserting movement which is generally parallel to the side wall 48 and which is spaced adjacent the side wall 48 to allow the section 62 to pass between the user's big toe 32 and the user's second toe 70. As will be more fully pointed out hereinafter, the toe engaging structure 58 defines a tapered passage 76 which diverges toward the opening 56 in the rear wall 54.

The planar ball-engaging structure 60 comprises a plate like member 72 generally coplanar with the bottom wall 36. The member 72 extends rearwardly of the rear wall 54 and extends laterally from the axis 68 beyond the confines of the side wall 48. The member 72 conveniently provides a beveled edge 74.

As illustrated, the device 10 has the toe engaging structure 58 and the ball-engaging structure 60 on the right side of the receptacle 28. It will also be appreciated that the forward edge 40 is inclined so that the right side of the device 10 is of greater dimension parallel to the axis 68 than the left side. The purpose of the inclining forward edge 40 is to facilite retreival of articles from a corner. It will be appreciated that if the forward edge 40 were perpendicular to the axis 68 and an article was in the corner of the shower, the toes of the user outside of the wall 48 would come in contact with the shower wall and prevent retreival of the article without moving the article away from the corner. By inclining the forward edge 40 so that it defines an acute angle with the axis 68 inside the receptacle 28, an article can be retreived from the corner without having to move it.

As will be apparent, the toe engaging structure 58 acts to support the receptacle 28 during raising movement thereof and acts to transmit forward motion of the user's foot 34 into forward movement of the receptacle 28. The ball-engaging structure 60 acts to prevent rotation of the receptacle 28 about the axis 68 as may occur when a bar of soap or other article is loaded into the receptacle 28.

Although the receptacle 28 may be of any desired size, it is preferably in the range of 2–4 inches wide, i.e. between the side walls 46, 48. Similarly, the length of the bottom wall 36 may be as desired but is preferably on the order of about 2–5 inches in length as measured across the short side thereof. The opening into the passage 76 must be of sufficient size to accommodate the big toe of normal sized adults. Accordingly, the entrance to the passage 76 is at least about ¾ inches wide and ¾ inches high at the top of the arcuate member 64. More desirably, the entrance to the passage 76 is on the order of about 1½ inches wide and of similar height.

The bracket 12 and the scoop 16 may be made of any suitable materials. Preferably, the bracket 12 is an extruded section of organic polymeric material such as ABS. The scoop 16 is made of a similar material and is preferably injection molded. Desirably, the scoop 16 is made of a bodily flexible material such as polyethylene and the top wall 64 of the toe engaging structure 58 is sufficiently thin to be flexible. Accordingly, the top wall 64 is designed to be expandable in order to accommodate and lightly grip the big toe of most individuals.

In use, the scoop 16 is normally suspended from the bracket 12 and acts to support soap or other bath articles in the receptacle 28. The scoop 16 may be removed from the bracket 12 either linearly as illustrated by the arrow 78 or arcuately as illustrated by the arrow 80 to free the side wall 46 from the slot 26.

To retrieve soap or other bath articles from the floor 82 of the shower, the user removes the scoop 16 from the bracket 12 and drops the scoop 16 onto the shower floor 82. If the scoop 16 comes to rest in an upside-down position on the shower floor 82, it can be readily moved to the upright position illustrated in FIG. 2 merely by flipping it over with the foot. The user then extends the big toe 32 along the axis 68 into the structure 58 as illustrated in FIG. 2. The user is then able to manipulate the scoop 16 to retrieve soap or other bath articles from the shower floor 82. To this end, the user slides the scoop 16 forwardly so that the beveled front edge 38 slides under the soap bar. If the soap bar slides across the shower floor 82, the user can move the soap bar over against one of the shower walls so that the soap bar is incapable of sliding further and then slipping the front edge 38 under the soap bar until it is positioned in the receptacle 28 on the bottom wall 36. The user can then elevate the soap bar by standing on one foot and raising the other foot so that the soap bar and scoop can be retrieved by the user's hand. In this fashion, one can retrieve a soap bar from the floor of a running shower without getting one's head wet.

Although the invention has been described in its preferred form with a certain degree of particularlity, it is understood that the present disclosure of the preferred form has been made only by way of example and numerous changes in the details of construction and the combination of arrangement of parts may be resorted to without departing from the spirit and scope of the invention as hereinafter claimed. It is intended that the patent shall cover, by suitable expression in the appended claims, whatever features of patentable novelty exists in the invention disclosed.

I claim:

1. A combined soap dish and retriever, comprising
a bracket mountable on a wall;
a foot mountable scoop removably supported by the bracket in an article supporting position and comprising
a receptacle having a bottom providing a front edge and means along a major portion of the sides of the bottom extending upwardly from the bottom providing a constraint for the article in the receptacle; and
means carried by the receptacle for supporting the same from the bare foot of a user.

2. The soap dish and retriever of claim 1 wherein the supporting means comprises a member providing a passage for receiving a bare toe of a user.

3. The soap dish and retriever of claim 2 wherein the member is bodily flexible.

4. A foot mountable scoop comprising
a receptacle having a bottom providing a front edge and side walls extending along a major portion of the side edges of the bottom and projecting upwardly therefrom; and
means carried by the receptacle for suspending the receptacle from a bare toe of a user.

5. The foot mountable scoop of claim 4 wherein the supporting means comprises a member providing a passage for receiving at least one and less than all of the bare toes of a user.

6. A foot mountable scoop comprising
a receptacle having a bottom providing a front edge and side walls extending along a major portion of the side edges of the bottom and projecting upwardly therefrom; and
means carried by the receptacle for supporting the receptacle on a bare toe of the user including a member providing a tapered passage for receiving a big toe of the user, the passage defining a path of toe insertion including an inlet and being divergent toward the inlet.

7. The scoop of claim 6 further comprising means preventing rotation of the receptacle about the axis of the passage.

8. The scoop of claim 7 wherein the rotation preventing means comprises a member rigid with the rear of the receptacle extending laterally of the passage axis.

9. The scoop of claim 8 wherein the member is substantially planar for underlying the ball of the user's foot.

10. The scoop of claim 9 wherein the receptacle provides a rear wall providing an opening therethrough and the tapered passage is exposed through the rear wall opening.

11. The combined soap dish and retriever of claim 1 wherein the supporting means is functionally independent of the receptacle.

12. A foot mountable scoop comprising
a receptacle having a bottom providing a front edge and side walls extending along a major portion of the side edges of the bottom and projecting upwardly therefrom; and means carried by the receptacle for supporting the receptacle on a bare toe of a user including means providing a passage adjacent a first side of the receptacle for receiving a toe of the user, the passage defining a path of toe insertion, and the front edge is inclined to the path of toe insertion and defines an acute angle in the receptacle.

13. A foot mountable scoop of one piece construction from an organic polymeric material, comprising a receptacle having a bottom providing a front edge, side edges and a rear edge, means along a major portion of the side edges extending upwardly from the bottom providing lateral constraint for an object in the receptacle, and a rear wall along the rear edge providing an opening therethrough; and means carried by the receptacle for supporting the same on a bare toe of a user, including a first member having a top wall and a pair of side walls opening toward the rear of the receptacle through the rear wall opening providing a passage divergent toward the rear of the receptacle for receiving a big toe of the user; and means preventing rotation of the receptacle about an axis of the passage, including a second member rigid with the receptacle extending rearwardly away from the receptacle and laterally of the axis.

14. The scoop of claim 13 wherein the first member top wall is arcuate.

15. The scoop of claim 13 wherein the receptacle bottom and second member are substantially coplanar.

16. The scoop of claim 13 wherein the first member is positioned adjacent a first side of the receptacle and the second member extends laterally of the receptacle beyond the sidewall on the first side of the receptacle.

17. A method of using a foot mountable scoop of the type comprising a receptacle having a bottom providing a front edge and side walls extending along a portion of the side edges of the bottom and extending upwardly therefrom and means carried by the receptacle for supporting the receptacle on a bare foot of the user, comprising placing the scoop on a shower floor;

supporting the scoop on a bare foot of a user;

sliding the front edge of the receptacle under an article on the shower floor and delivering the article into the receptacle;

elevating the receptacle with the bare foot; and grasping the article from the receptacle in an elevated receptacle position.

* * * * *